US011288990B1

(12) United States Patent
Strandborg et al.

(10) Patent No.: US 11,288,990 B1
(45) Date of Patent: Mar. 29, 2022

(54) DISPLAY APPARATUS AND METHOD INCORPORATING PER-PIXEL SHIFTING

(71) Applicant: Varjo Technologies Oy, Helsinki (FI)

(72) Inventors: Mikko Strandborg, Hangonkylä (FI); Klaus Melakari, Espoo (FI)

(73) Assignee: Varjo Technologies Oy, Helsinki (FI)

( * ) Notice: Subject to any disclaimer, the term of this patent is extended or adjusted under 35 U.S.C. 154(b) by 0 days.

(21) Appl. No.: 17/199,758

(22) Filed: Mar. 12, 2021

(51) Int. Cl.
*G09G 3/36* (2006.01)
*G09G 3/00* (2006.01)

(52) U.S. Cl.
CPC ..... *G09G 3/007* (2013.01); *G09G 3/36* (2013.01)

(58) Field of Classification Search
CPC ..... G09G 3/007; G09G 3/3611
See application file for complete search history.

(56) References Cited

U.S. PATENT DOCUMENTS 10,984,713 B1 * 4/2021 Tan ..... G09G 3/3233
2008/0291152 A1 * 11/2008 Nakao ..... H04N 13/398 345/102

* cited by examiner

*Primary Examiner* — Towfiq Elahi
(74) *Attorney, Agent, or Firm* — Ziegler IP Law Group, LLC

(57) ABSTRACT

A display apparatus including: image renderer having array of pixels; liquid-crystal device comprising: liquid-crystal structure, wherein portions of liquid-crystal structure are arranged in front of corresponding pixels of said array; and control circuit including circuit elements employed to electrically control corresponding portions of liquid-crystal structure to shift light emanating from corresponding pixels to corresponding target positions; and processor(s) configured to: generate individual drive signals for circuit elements, based on corresponding target positions to which light emanating from corresponding pixels are to be shifted upon passing through corresponding portions of liquid-crystal structure; and send individual drive signals to control circuit to drive circuit elements to address corresponding portions of liquid-crystal structure separately, whilst displaying output image frame via image renderer.

16 Claims, 3 Drawing Sheets

DISPLAY APPARATUS AND METHOD INCORPORATING PER-PIXEL SHIFTING

TECHNICAL FIELD

The present disclosure relates to display apparatuses incorporating per-pixel shifting. Moreover, the present disclosure relates to methods of displaying that are implemented via such display apparatuses.

BACKGROUND

In recent times, continuous advancements in display technology have been and are being made to improve high-resolution display capabilities of a display device (for example, a head-mounted display (HMD), a television, a desktop computer, a laptop computer, a tablet computer, a phablet, a smartphone, a smartwatch, a projection device, and the like), in order to present high-resolution images to a user of the display device.

Conventional display devices employ various equipment and techniques to generate and present the high-resolution images to be shown to the user of the display device. These display devices include conventional image renderers (for example, such as a display, a projector, and the like) that employ a fixed grid of pixels for displaying images, the pixels being arranged in any pattern (such as a regular rectangular array pattern, circular pattern, and the like).

However, provision of the images using the conventional image renderers having the fixed grid of pixels has certain problems associated therewith. For display devices that employ such image renderers, the images that are presented typically have a limited contrast resolution. Resultantly, some features (such as edges, corners, ridges, and the like) of the images that are not exactly horizontal or vertical are sub-optimally reproduced by the grid of pixels and do not appear in their intended form to the user. As an example, slanting edges represented in the images may appear jagged to the user. Moreover, sharp features are prone to produce undesirable effects (such as moiré effect) in the images owing to very limited contrast resolution capabilities of said display devices. Such undesirable effects deteriorate contrast quality of the images, and consequently lead to a poor viewing experience for the user.

Therefore, in light of the foregoing discussion, there exists a need to overcome the aforementioned drawbacks associated with provision of high-resolution images in display devices.

SUMMARY

The present disclosure seeks to provide a display apparatus incorporating per-pixel shifting. The present disclosure also seeks to provide a method of displaying that is implemented via such display apparatus. An aim of the present disclosure is to provide a solution that overcomes at least partially the problems encountered in prior art.

In one aspect, an embodiment of the present disclosure provides a display apparatus comprising:

an image renderer having an array of pixels;

a liquid-crystal device comprising:

a liquid-crystal structure arranged in front of the array of pixels, wherein a plurality of portions of the liquid-crystal structure are arranged in front of corresponding pixels of said array; and a control circuit comprising a plurality of circuit elements that are to be employed to electrically control corresponding portions of the liquid-crystal structure to shift light emanating from the corresponding pixels to corresponding target positions on an image plane; and at least one processor configured to:

generate individual drive signals for the plurality of circuit elements, based on the corresponding target positions on the image plane to which the light emanating from the corresponding pixels are to be shifted upon passing through the corresponding portions of the liquid-crystal structure; and send the individual drive signals to the control circuit to drive the plurality of circuit elements to address the corresponding portions of the liquid-crystal structure separately, whilst displaying a given output image frame via the image renderer.

In another aspect, an embodiment of the present disclosure provides a method of displaying, via a display apparatus comprising an image renderer and a liquid-crystal device, the liquid-crystal device comprising a liquid-crystal structure, arranged in front of an array of pixels of the image renderer, and a control circuit comprising a plurality of circuit elements that are employed to electrically control corresponding portions of the liquid-crystal structure to shift light emanating from corresponding pixels to corresponding target positions on an image plane, the method comprising:

generating individual drive signals for the plurality of circuit elements, based on the corresponding target positions on the image plane to which the light emanating from the corresponding pixels are to be shifted upon passing through the corresponding portions of the liquid-crystal structure; and sending the individual drive signals to the control circuit to drive the plurality of circuit elements to address the corresponding portions of the liquid-crystal structure separately, whilst displaying a given output image frame via the image renderer.

Embodiments of the present disclosure substantially eliminate or at least partially address the aforementioned problems in the prior art, and enable presentation of high-quality and high-contrast resolution output image frames by way of incorporating per-pixel shifting for light emanating from pixels of image renderers, in the display apparatus.

Additional aspects, advantages, features and objects of the present disclosure would be made apparent from the drawings and the detailed description of the illustrative embodiments construed in conjunction with the appended claims that follow.

It will be appreciated that features of the present disclosure are susceptible to being combined in various combinations without departing from the scope of the present disclosure as defined by the appended claims.

BRIEF DESCRIPTION OF THE DRAWINGS

The summary above, as well as the following detailed description of illustrative embodiments, is better understood when read in conjunction with the appended drawings. For the purpose of illustrating the present disclosure, exemplary constructions of the disclosure are shown in the drawings. However, the present disclosure is not limited to specific methods and instrumentalities disclosed herein. Moreover, those skilled in the art will understand that the drawings are not to scale. Wherever possible, like elements have been indicated by identical numbers.

Embodiments of the present disclosure will now be described, by way of example only, with reference to the following diagrams wherein:

FIG. 4A illustrates an exemplary schematic illustration of an image plane before per-pixel shifting, while

Figure 1:
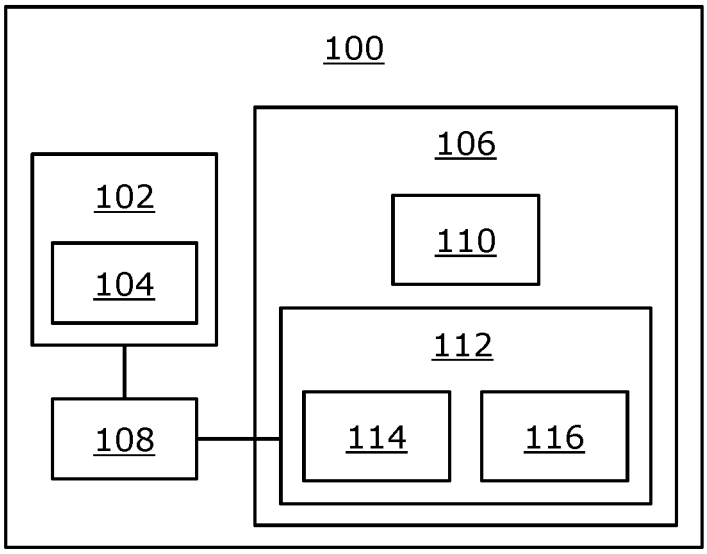
FIGS. 1 and 2 illustrate block diagrams of architectures of a display apparatus, in accordance with different embodiments of the present disclosure.

In the accompanying drawings, an underlined number is employed to represent an item over which the underlined number is positioned or an item to which the underlined number is adjacent. A non-underlined number relates to an item identified by a line linking the non-underlined number to the item. When a number is non-underlined and accompanied by an associated arrow, the non-underlined number is used to identify a general item at which the arrow is pointing.

DETAILED DESCRIPTION OF EMBODIMENTS

The following detailed description illustrates embodiments of the present disclosure and ways in which they can be implemented. Although some modes of carrying out the present disclosure have been disclosed, those skilled in the art would recognize that other embodiments for carrying out or practising the present disclosure are also possible.

In one aspect, an embodiment of the present disclosure provides a display apparatus comprising:

an image renderer having an array of pixels;

a liquid-crystal device comprising:

a liquid-crystal structure arranged in front of the array of pixels, wherein a plurality of portions of the liquid-crystal structure are arranged in front of corresponding pixels of said array; and a control circuit comprising a plurality of circuit elements that are to be employed to electrically control corresponding portions of the liquid-crystal structure to shift light emanating from the corresponding pixels to corresponding target positions on an image plane; and at least one processor configured to:

generate individual drive signals for the plurality of circuit elements, based on the corresponding target positions on the image plane to which the light emanating from the corresponding pixels are to be shifted upon passing through the corresponding portions of the liquid-crystal structure; and send the individual drive signals to the control circuit to drive the plurality of circuit elements to address the corresponding portions of the liquid-crystal structure separately, whilst displaying a given output image frame via the image renderer.

In another aspect, an embodiment of the present disclosure provides a method of displaying, via a display apparatus comprising an image renderer and a liquid-crystal device, the liquid-crystal device comprising a liquid-crystal structure, arranged in front of an array of pixels of the image renderer, and a control circuit comprising a plurality of circuit elements that are employed to electrically control corresponding portions of the liquid-crystal structure to shift light emanating from corresponding pixels to corresponding target positions on an image plane, the method comprising:

generating individual drive signals for the plurality of circuit elements, based on the corresponding target positions on the image plane to which the light emanating from the corresponding pixels are to be shifted upon passing through the corresponding portions of the liquid-crystal structure; and sending the individual drive signals to the control circuit to drive the plurality of circuit elements to address the corresponding portions of the liquid-crystal structure separately, whilst displaying a given output image frame via the image renderer.

The present disclosure provides the aforementioned display apparatus and the aforementioned method of displaying. In the display apparatus and the method, individual drive signals are generated for each circuit element to control shifting of light emanating from each pixel of the image renderer to a corresponding target position in a separate (i.e. customized) manner. In other words, an amount of shift required for shifting the light emanating from each pixel to a corresponding target position is well-controlled separately i.e. on a pixel-by-pixel basis. Beneficially, in this manner, the given target position corresponding to the given pixel could be accurately and precisely controlled, for example, on a level of sub-micrometre accuracy in real-time (without any latency). This infinitely increases a contrast resolution (namely, a contrast quality) in the given output image frame, thus contrast details in the given output image frame are optimally well-presented to a user of the display apparatus. As an example, slanting edges represented in the given output image frame appear slanting to the user. Moreover, due this high-contrast resolution capability of said display apparatus, undesirable effects (such as moiré effect) in the given output image frame are potentially eliminated. The method is fast, reliable and can be implemented with ease.

Throughout the present disclosure, the term "display apparatus" refers to a display device that is capable of displaying images. These images optionally constitute a visual scene. Examples of the display apparatus include, but are not limited to, a head-mounted display (HMD), a television, a desktop computer, a laptop computer, a tablet computer, a phablet, a smartphone, a smartwatch, a projection device (such as a projector).

Optionally, the display apparatus is implemented as the HMD. The term "head-mounted display" refers to specialized equipment that is configured to present an extended-reality (XR) environment to a user when said head-mounted display, in operation, is worn by the user on his/her head. The HMD is implemented, for example, as an XR headset, a pair of XR glasses, and the like, that is operable to display a visual scene of the XR environment to the user. In such a case, the output image frames constitute the visual scene. The term "extended-reality" encompasses virtual reality (VR), augmented reality (AR), mixed reality (MR), and the like.

Throughout the present disclosure, the term "image renderer" refers to equipment that, in operation, renders (i.e. displays and/or projects) the output image frames that are to be shown to the user of the display apparatus. Herein, the term "output image frame" refers to an image frame that serves as an output to be displayed by the image renderer.

In an embodiment, the image renderer is implemented as a display. In this regard, the given output image frame is displayed at the display. Examples of the display include, but are not limited to, a Liquid Crystal Display (LCD), a Light-Emitting Diode (LED)-based display, an Organic LED (OLED)-based display, a micro OLED-based display, an Active Matrix OLED (AMOLED)-based display, and a Liquid Crystal on Silicon (LCoS)-based display. Optionally, the display has a multi-layered structure. In another embodiment, the image renderer is implemented as a projector. In this regard, the given output image frame is projected onto a projection screen or directly onto a retina of the user's eyes. Examples of the projector include, but are not limited to, an LCD-based projector, an LED-based projector, an OLED-based projector, an LCoS-based projector, a Digital Light Processing (DLP)-based projector, and a laser projector.

Optionally, the image renderer could be a multi-resolution image renderer, or a single-resolution image renderer. Multi-resolution image renderers are configured to render the output image frames at two or more display resolutions, whereas single-resolution image renderers are configured to render the output image frames at a single display resolution only. Herein, the term "display resolution" of the image renderer refers to a total number of pixels in each dimension of the image renderer, or to a pixel density (namely, a number of pixels per unit distance or area) in the image renderer.

It will be appreciated that the array of pixels in the image renderer could be a one-dimensional array of pixels or a two-dimensional array of pixels. The pixels (of said array) are arranged in a required manner (for example, such as a rectangular two-dimensional grid, a polygonal arrangement, a circular arrangement, an elliptical arrangement, a freeform arrangement, and the like) on an image rendering surface of the image renderer.

Optionally, a given pixel of the image render comprises at least one sub-pixel. A given sub-pixel is a separately addressable single-colour picture element. In some implementations, the given pixel comprises a single sub-pixel, whereas in other implementations, the given pixel comprises a plurality of sub-pixels. As an example, the given pixel may comprise three sub-pixels in a Red-Green-Blue (RGB) sub-pixel arrangement, wherein the given pixel comprises a red sub-pixel, a green sub-pixel, and a blue sub-pixel that are arranged in a one-dimensional array. As another example, the given pixel may comprise five sub-pixels in a Red-Red-Green-Green-Blue (RRGGB) sub-pixel arrangement, wherein the given pixel comprises two red sub-pixels, two green sub-pixels, and one blue sub-pixel that are arranged in a PenTile® matrix layout.

Throughout the present disclosure, the term "liquid-crystal device" refers to a device that enables shifting of light passing therethrough using a liquid-crystal substance (namely, a liquid-crystal medium). The liquid-crystal device can be understood to steer the light passing therethrough. The liquid-crystal device can be an active-matrix liquid-crystal device, a passive-matrix liquid-crystal device, a super-twisted nematic (STN) liquid-crystal device, and the like. Notably, each portion (namely, a separately controllable partition) of the liquid-crystal structure is arranged in front of a corresponding pixel of the array of pixels. In a first example, 4 portions A1, A2, A3, and A4 of the liquid-crystal structure may be arranged in front of 4 pixels B1, B2, B3, and B4 of said array, respectively. The liquid-crystal structure comprises the liquid-crystal substance. In operation, a given circuit element (of the control circuit) applies a requisite drive signal (namely, an electrical signal, such as a voltage signal) to control a corresponding portion (and in particular, the liquid-crystal substance contained within the corresponding portion) of the liquid-crystal structure in a required manner, so as to shift light emanating from a corresponding pixel to a corresponding target position on the image plane. Beneficially, an amount (specifically, a magnitude and a direction) of shift required for shifting the light emanating from the corresponding pixel to the corresponding target position is controlled separately i.e. on a pixel-by-pixel basis. Therefore, shifting of the light can be performed in a non-uniform (i.e. customized) manner across an entirety of the image plane. It is also possible to use the display apparatus to perform shifting of the light in a uniform manner across the image plane, by optionally generating a same drive signal for each of the plurality of circuit elements.

The term "image plane" refers to a given imaginary plane on which the given output image frame is visible to the user. It will be appreciated that the magnitude and the direction of the shift may be indicated by a shift vector. Optionally, the drive signal applied by the given circuit element controls an orientation of liquid-crystal molecules of the liquid-crystal substance contained within the corresponding portion of the liquid-crystal structure. The magnitude of the shift is controlled by a magnitude of the drive signal, whereas the direction of the shift is controlled by the orientation of the liquid-crystal molecules. Referring to the first example, 4 circuit elements C1, C2, C3, and C4 may be employed to electrically control the 4 portions A1, A2, A3, and A4 of the liquid-crystal structure to shift light emanating from the 4 pixels B1, B2, B3, and B4, respectively, to corresponding target positions such that each of the 4 pixels B1-B4 is shifted to 3 different target positions at three different instances of time. For example, at a time instant T1, the 4 pixels B1, B2, B3, and B4 may be shifted to target positions D1, D2, D3, and D4, respectively; at a time instant T2, the 4 pixels B1, B2, B3, and B4 may be shifted to target positions D5, D6, D7, and D8, respectively; and at a time instant T3, the 4 pixels B1, B2, B3, and B4 may be shifted to target positions D9, D10, D11, and D12, respectively.

It will be appreciated that the liquid-crystal device is optimized according to the image renderer. For optimum functioning of the display apparatus, the liquid-crystal device is designed according to a display resolution of the image renderer. Optionally, the light emanating from a given pixel of the image renderer is shifted by a fraction of the given pixel. In other words, the light emanating from the given pixel is shifted by sub-pixel amounts. More optionally, the light emanating from a given pixel of the image renderer is shifted by a fraction of a sub-pixel of the given pixel.

Throughout the present disclosure, the term "circuit element" refers to operational component of the control circuit. The operational component can be, for example, an electrical component (such as a resistor, a transistor, a capacitor, an inductor, an electrode, a wiring, and the like), an optoelectronic component, an electromechanical component, and the like.

Optionally, a given circuit element is employed to electrically control a given portion of the liquid-crystal structure to shift light emanating from a given pixel to a plurality of target positions according to a shifting sequence. In operation, the given circuit element applies a plurality of drive signals over a plurality of time instants, to control the given portion to shift the light emanating from the given pixel to the plurality of target positions according to the shifting sequence. Said shifting sequence is time-based, meaning that the light emanating from the given pixel is shifted to different target positions, at different instances of time. Given that the light emanating from the given pixel is shifted to X target positions at X time instants, X output image frames (corresponding to the given output image frame that is displayed via the image renderer) would be shown (on the image plane) to the user at their corresponding X target positions, X being equal to or greater than 2. The user is unable to discern the shift of the given pixel and perceives a unified view of the given output image frame having a resolution that is X times higher than the display resolution. In other words, the resolution of the given output image frame appears to be enhanced with respect to the display resolution of the image renderer. The shifting sequence may be a raster scanning sequence, a random sequence, a Halton sequence (for example, 256 or 1024 first locations of Halton (2, 3)), or similar.

Optionally, the display apparatus further comprises a collimator arranged between the image renderer and the liquid-crystal structure. The collimator focuses light emanating from the pixels of the image renderer as the light travels from the image renderer towards the liquid-crystal structure. The collimator minimizes spreading of light emanating from each pixel of the image renderer, thereby minimizing blending (or overlap) of light emanating from one pixel of the image renderer with light emanating from another pixel of the image renderer. Moreover, optionally, the collimator allows for properly blending light from sub-pixels each pixel before the light is incident upon the liquid-crystal structure. Therefore, the collimator performs both differentiating and collimating functions for the light emanating from the pixels of the image renderer. It will be appreciated that the collimator may be implemented as a perforated plate, a lenticular array, an array of nanotubes (wherein each nanotube of the array collimates light emanating from a single pixel of the image renderer), a fiber optic plate, or similar.

The at least one processor controls overall operation of the display apparatus. In particular, the at least one processor is communicably coupled to and controls operation of the image renderer and the liquid-crystal device (and specifically, the plurality of circuit elements of the control circuit of the liquid-crystal device). The output image frames are displayed via the image renderer. Upon displaying, the output image frames are visible to the user. Notably, the at least one processor generates the individual drive signal for the plurality of circuit elements, in a manner that the light emanating from the corresponding pixels is precisely directed to be incident on the corresponding target positions on the image plane, upon passing through the corresponding portions of the liquid-crystal structure. It will be appreciated that different drive signals are generated for different circuit elements corresponding to different portions of the liquid-crystal structure. Referring to the first example, the at least one processor is configured to generate 4 individual drive signals E1, E2, E3, and E4 for the 4 circuit elements C1, C2, C3, and C4, based on the 4 target positions D1, D2, D3, and D4 on the image plane to which the light emanating from the 4 pixels B1, B2, B3, and B4 are to be shifted upon passing through the 4 portions A1, A2, A3, and A4 of the liquid-crystal structure, respectively.

Upon generating the individual drive signals, when the at least one processor sends the individual drive signals to the control circuit to drive the plurality of circuit elements, different portions of the liquid-crystal structure are addressed differently to shift the light passing therethrough to different target positions.

Optionally, when generating the individual drive signals, the at least one processor is configured to:

extract a plurality of features from the given output image frame;

determine a given group of pixels that are to display a given feature of the given output image frame;

determine a given target position on the image plane to which light emanating from the given pixel of the given group is to be shifted during display of the given output image frame; and generate a drive signal for a given circuit element to be employed to address a given portion of the liquid-crystal structure that lies in front of the given pixel, based on a direction pointing from an initial target position of the light emanating from the given pixel towards the given target position.

In this regard, the drive signal for the given circuit element is generated in a content-based manner. The given target position for the given pixel is determined based on visual content (i.e. the given feature) represented by the given group of pixels including the given pixel. Then, the drive signal required to shift the light emanating from the given pixel is generated based on the direction pointing from the initial target position towards the given target position. Herein, the term "initial target position" refers to an original target position attained by the light emanating from the given pixel on the image plane when the given portion of the liquid-crystal structure (that lies in front of the given pixel) is not addressed (namely, is turned off). In such a case, the light emanating from the given pixel undergoes simple refraction as it passes through the given portion of the liquid-crystal structure. Resultantly, the light is incident at the initial target position on the image plane.

Optionally, the at least one processor is configured to employ at least one image processing algorithm to extract the plurality of features from the given output image frame. Examples of the plurality of features include, but are not limited to, edges, corners, blobs, ridges, and texture detail. Examples of the at least one image processing algorithm include, but are not limited to, an edge-detection algorithm, a corner-detection algorithm, a blob-detection algorithm, a feature descriptor algorithm, a feature detector algorithm. Such image processing algorithms are well-known in the art.

Optionally, the at least one processor is configured to determine the target position on a pixel-by-pixel basis. Alternatively, optionally, the at least one processor is configured to fix at least one target position corresponding to at least one pixel in the given group, and then determine target position(s) corresponding to remaining pixel(s) in the given group according to the at least one target position that is fixed. Optionally, in this regard, a given target position for a given pixel is fixed as an initial target position for the given pixel. In an example, the given group may comprise 6 pixels J1, J2, J3, J4, J5, and J6 that are to display the given feature (for example, such as an inclined line that is inclined at an angle of 15 degrees) of the given output image frame. Herein, the at least one processor may be configured to fix target positions corresponding to the pixels J1 and J6 in the given group, and then determine target positions corresponding to remaining pixels J2, J3, and J4 in the given group according to the fixed target positions corresponding to the pixels J1 and J6.

It will be appreciated that different target positions to which light emanating from different pixels of the given group is to be shifted, is optionally determined based on a geometry of the given feature. Optionally, the at least one processor is configured to determine a slope of the given feature to ascertain the geometry of the given feature. When the slope (namely, steepness) of the given feature is known, the at least one processor could accurately determine inclination and/or straightness of the given feature to determine the target positions for pixels of the given group that display the given feature. Optionally, the step of determining the slope of the given feature employs at least one mathematical formula. Moreover, the direction pointing from the initial target position of the light emanating from the given pixel towards the given target position is indicative of the amount of shift required for the given pixel. Therefore, this direction is optionally used to generate the (requisite) drive signal for shifting light emanating from the given pixel, for implementing accurate per-pixel light shifting in the display apparatus.

Optionally, when generating the individual drive signals, the at least one processor is configured to select the given feature from amongst the plurality of features based on a type of the given feature. Optionally, in this regard, the at least one processor is configured to determine the given target position on the image plane to which light emanating from the given pixel of the given group is to be shifted during display of the given output image frame, based on the type of the given feature. Optionally, geometries of the plurality of features are different, based on type of the plurality of features. In such a case, different geometries of the plurality of features would require different amounts of shifting of light emanating from a plurality of groups of pixels that are to display the plurality of features. In that case, the at least one processor is optionally configured to select the given feature from amongst the plurality of features according to the geometry of the given feature, to determine per-pixel target positions of pixels displaying the given feature. When the given feature is selected, requisite per-pixel drive signals are generated for corresponding circuit elements to address the corresponding portions of the liquid-crystal structure that lie in front of the pixels displaying the given feature.

In an embodiment, the given feature is any of: an inclined edge, an inclined line. Optionally, when the given feature has an inclined geometry, the at least one processor is configured to determine a target position corresponding to each pixel in the given group of pixels that are to display the given feature in a different manner, such that the light emanating from each pixel in the given group is shifted in a way that the given feature (having the inclined geometry) appears smooth (namely, not jagged) on the image plane. Typically, the given feature having the inclined geometry is prone to produce undesirable effects (such as moiré effect) when the light emanating from the given feature is improperly shifted (for example, when light from all pixels is shifted uniformly). Beneficially, the given target position corresponding to the given pixel (belonging to the given group of pixels that are to display the given feature) could be accurately controlled, for example, on a level of sub-micrometer accuracy in real-time (without any latency). Therefore, the given feature that is inclined, is accurately displayed (namely, reproduced), without any undesirable effects, by shifting the light emanating from the given pixel of the given group with a high precision using a customized drive signal. This produces an infinite contrast resolution along features in the given output image frame when the given output image frame is viewed by the user.

In another embodiment, the given feature is any of: a straight edge, a straight line. Optionally, in this regard, the given feature is any of: a horizontal edge, a horizontal line, a vertical edge, a vertical line. Optionally, when the given feature has a straight geometry, the at least one processor is configured to determine target position corresponding to each pixel in the given group in a same manner, such that the light emanating from each pixel in the given group is shifted in a same way so that the given feature (having the straight geometry) appears straight and/or smooth in the given output image frame.

In yet another embodiment, the given feature is any of: a curved edge, a curved line, a freeform edge, a freeform line, a jagged edge, a jagged line. In such a case, the at least one processor optionally considers the given feature to be a group at least one of: an inclined edge, a straight edge, an inclined line, a straight line, and facilitates per-pixel light shifting for such the given feature as discussed above.

Optionally, when generating the individual drive signals, the at least one processor is configured to determine the given target position to which the light emanating from the given pixel is to be shifted, based on at least one target position on the image plane to which light emanating from at least one neighbouring pixel of the given group is to be shifted during the display of the given output image frame. Optionally, in this regard, an amount of shift required for shifting the light emanating from the given pixel to the given target position is determined according to an amount of shift required for shifting the light emanating from the at least one neighbouring pixel to the at least one target position. Herein, a "neighbouring pixel" is a pixel of the given group that lies in a proximity of the given pixel. Optionally, the at least one neighbouring pixel is adjacent to the given pixel. It will be appreciated that when the determination of the given target position corresponding to the given pixel depends on the at least one target position corresponding to the at least one neighbouring pixel, said determination has a high accuracy and a high precision. Moreover, in this case, the (neighbouring) pixels of the given group are shifted consistently with respect to each other, using their individual drive signals. This ensures that the given feature (having the inclined geometry) appears smooth (and not jagged) in the given output image frame.

Optionally, when generating the individual drive signals, the at least one processor is configured to determine the given target position and the at least one target position for the given pixel and the at least one neighbouring pixel, respectively, in an iterative manner. In other words, adjustment in the amount of shift required for shifting the light emanating from the given pixel to the given target position is performed in the iterative manner, according to the amount of shift required for shifting the light emanating from the at least one neighbouring pixel to the at least one target position. In such a case, the given target position is optimally iteratively adjusted (or re-adjusted) according to the at least one target position until the said target positions are determined to be such that the given feature (for example, having the inclined geometry) appears perfectly or near-perfectly smooth (and not jagged) in the given output image frame. Then, the at least one processor is configured to generate a requisite drive signal for the given circuit element to be employed to address the given portion of the liquid-crystal structure that lies in front of the given pixel, to facilitate the shifting of the light emanating from the given pixel to the given target position.

Referring to the first example, the given group may comprise the 4 pixels B1-B4 that are to display the given feature (for example, such as an inclined edge that is inclined at an angle of 30 degrees) of the given output image frame. Herein, at the time instant T1, the target position D1 to which the light emanating from the pixel B1 is to be shifted, may depend on the target position D2 to which the light emanating from the pixel B2 is to be shifted. Similarly, the target position D2 to which the light emanating from the pixel B2 is to be shifted, may depend on the target positions D1 and D3 to which the light emanating from the pixel B1 and B3 is to be shifted. In such a case, the at least one processor is configured to generate the 4 drive signals E1, E2, E3, and E4 for the 4 circuit elements C1, C2, C3, and C4 that are employed to address the 4 portions A1, A2, A3, and A4 of the liquid-crystal structure that lie in front of the 4 pixels B1, B2, B3, and B4, respectively in a manner that the light emanating from the pixels B1, B2, B3, and B4 may be shifted to the 4 target positions D1, D2, D3, and D4 from 4 initial target positions I1, I2, I3, and I4, respectively. Then, the inclined edge appears smooth (and, not jagged) in the given output image frame. One such exemplary scenario has been illustrated in conjunction with FIGS. 4A and 4B, as described below.

Optionally, the liquid-crystal structure comprises at least a first layer and a second layer of the liquid-crystal substance, a given portion of the liquid-crystal structure comprising a given portion of the first layer and a given portion of the second layer, wherein, when addressed, the given portion of the first layer directs light received thereat from a corresponding pixel towards a first direction, and wherein, when addressed, the given portion of the second layer directs light received thereat from the given portion of the first layer in a second direction, the second direction being orthogonal to the first direction. Optionally, in this regard, the first and second layers are collectively addressable to direct the light emanating from the corresponding pixel to a corresponding target position that lies on the image plane extending across the first and second directions. In an embodiment the given portion of the first layer directs the light in a horizontal direction, while the given portion of the second layer directs the light in a vertical direction. In another embodiment, the given portion of the first layer directs the light in a vertical direction, while the given portion of the second layer directs the light in a horizontal direction.

Optionally, the plurality of circuit elements comprise a first group of circuit elements associated with the first layer and a second group of circuit elements associated with the second layer, wherein a first channel and a second channel are employed to drive the circuit elements of the first group and the circuit elements of the second group, respectively. In this regard, drive signals generated for the circuit elements of the first group and the circuit elements of the second group are communicated via the first channel and the second channel, respectively, said communication occurring from the at least one processor to the control circuit. The drive signals that are communicated via the first channel are responsible for driving the circuit elements of the first group to address the given portion of the first layer in a manner that the light received thereat from the corresponding pixel is directed towards the first direction, while the drive signals that are communicated via the second channel are responsible for driving the circuit elements of the second group to address the given portion of the second layer in a manner that the light received thereat from the given portion of the first layer is directed towards the second direction.

Throughout the present disclosure, the term "channel" refers to a communication channel. Optionally, a given channel is similar to a colour channel through which value of a given colour component of a given pixel is communicated from a display controller to the image renderer. Herein, the term "display controller" refers to an equipment that is configured for controlling operation of the image renderer according to display signals such as, Red-Green-Blue (RGB) signals, Luminance and two colour difference (YUV) signals, Cyan Magenta Yellow-Black (CMYK) signals, and the like.

In an embodiment, the control circuit further comprises an off-the-shelf display controller that is to be employed to address the plurality of portions of the liquid-crystal structure separately. Typically, the off-the-shelf display controller comprises at least three colour channels, wherein the display signals are communicated via the at least three channels, said communication occurring from the at least one processor to the image renderer via the off-the-shelf display controller. Examples of the off-the-shelf display controller include, but are not limited to, a DisplayPort® controller, a High-Definition Multimedia Interface (HDMI) controller, a Mobile Industry Processor Interface-Display Serial Interface (MIPI-DSI®) controller. In an example, the off-the-shelf display controller may comprise three channels, namely a Red colour channel, a Green colour channel, and a Blue colour channel. Herein, the Red-Green-Blue (RGB) signals comprising values of red, green, and blue colour components of all pixels of the image renderer, are communicated via the Red colour channel, the Green colour channel, and the Blue colour channel, respectively.

It will be appreciated that optionally any two colour channels out of the at least three colour channels of the off-the-shelf display controller are employed as the first channel and the second channel. In such a case, the off-the-shelf display controller could be programmed in a manner that the two colour channels out of the at least three colour channels would be active (to be employed as the first and second channels), while remaining colour channel(s) would be inactive (namely, inoperative) during functionality of the off-the-shelf display controller. In an example, the Red colour channel may be employed as the first channel, the Green colour channel may be employed as the second channel, and remaining channel(s) (such as the Blue colour channel) may be inactive.

Advantageously, the off-the-shelf display controller is an existing standard display controller and is therefore easily and readily available for use. This considerably decreases cost/time required for use, and avoids need for fabricating a new display controller. It will be appreciated that the off-the-shelf display controller is well compatible for use with existing image renderers. Optionally, the display apparatus comprises two separate off-the-shelf display controllers, wherein a first off-the-shelf display controller is configured to drive the image renderer with colour signals, while a second off-the-shelf display controller is configured to drive the plurality of circuit elements with the drive signals for shifting the light emanating from the pixels of the image renderer. The first off-the-shelf display controller is coupled to the at least one processor and the image renderer, while the second off-the-shelf display controller is coupled to the image renderer and the plurality of circuit elements of the control circuit.

In another embodiment, the control circuit comprises a customized display controller, wherein the customized display controller is customized to have two channels, and wherein the two channels are employed as the first channel and the second channel. Optionally, the customized display controller operates according to a customized communication standard. The customized display controller is designed to be compatibly coupled with the control circuit and the image renderer.

The present disclosure also relates to the method as described above. Various embodiments and variants disclosed above, with respect to the aforementioned first aspect, apply mutatis mutandis to the method.

Optionally, in the method, the step of generating the individual drive signals comprises:

extracting a plurality of features from the given output image frame;

determining a given group of pixels that are to display a given feature of the given output image frame;

determining a given target position on the image plane to which light emanating from a given pixel of the given group is to be shifted during display of the given output image frame; and generating a drive signal for a given circuit element to be employed to address a given portion of the liquid-crystal structure that lies in front of the given pixel, based on a direction pointing from an initial target position of the light emanating from the given pixel towards the given target position.

Optionally, in the method, the step of generating the individual drive signals further comprises selecting the given feature from amongst the plurality of features based on a type of the given feature.

Optionally, in the method, the given feature is any of: an inclined edge, an inclined line.

Optionally, in the method, the step of generating the individual drive signals further comprises determining the given target position to which the light emanating from the given pixel is to be shifted, based on at least one target position on the image plane to which light emanating from at least one neighbouring pixel of the given group is to be shifted during the display of the given output image frame.

Optionally, in the method, the given target position and the at least one target position are determined for the given pixel and the at least one neighbouring pixel, respectively, in an iterative manner.

Optionally, the liquid-crystal structure comprises at least a first layer and a second layer of a liquid-crystal substance, a given portion of the liquid-crystal structure comprising a given portion of the first layer and a given portion of the second layer, wherein the method further comprises:

addressing the given portion of the first layer to direct light received thereat from a corresponding pixel towards a first direction; and addressing the given portion of the second layer to direct light received thereat from the given portion of the first layer in a second direction, the second direction being orthogonal to the first direction.

Optionally, in the method, the plurality of circuit elements comprise a first group of circuit elements associated with the first layer and a second group of circuit elements associated with the second layer, wherein a first channel and a second channel are employed to drive the circuit elements of the first group and the circuit elements of the second group, respectively.

Optionally, in the method, the control circuit further comprises an off-the-shelf display controller that is employed to address the plurality of portions of the liquid-crystal structure separately.

Experimental Part

A test simulation for the aforementioned display apparatus incorporating per-pixel shifting was performed for vector graphics applications such as, font rendering, maps, computer-aided design (CAD) models based on spline-modelling, and similar. Based on the test simulation, it was observed the per-pixel shifting enables in achieving infinite contrast resolutions for all features of the vector graphics applications. It was observed experimentally that all edges (inclined edges and/or straight edges) and/or all lines (inclined lines and/or straight lines) are visibly sharp upon implementation of per-pixel shifting and have correct positions regardless of actual contrast resolution of the image renderer.

DETAILED DESCRIPTION OF THE DRAWINGS

Referring to FIG. 1, illustrated is a block diagram of architecture of a display apparatus 100, in accordance with an embodiment of the present disclosure. The display apparatus 100 comprises an image renderer 102 having an array 104 of pixels, a liquid-crystal device 106, and at least one processor (depicted as a processor 108). The liquid-crystal device 106 comprises a liquid-crystal structure 110, and a control circuit 112. The liquid-crystal structure 110 is arranged in front of the array 104 of pixels, wherein a plurality of portions of the liquid-crystal structure 110 are arranged in front of corresponding pixels of said array 104. The control circuit 112 comprises a plurality of circuit elements (depicted as circuit elements 114 and 116) that are to be employed to electrically control corresponding portions of the liquid-crystal structure 110.

Figure 2:
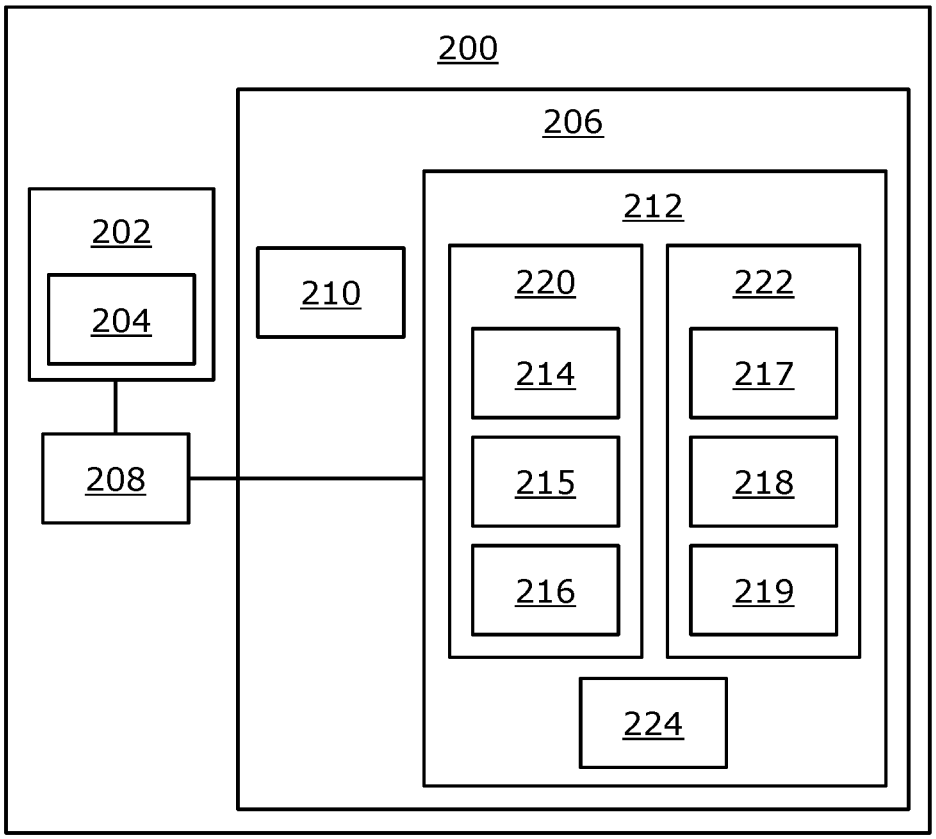

Referring to FIG. 2, illustrated is a block diagram of architecture of a display apparatus 200, in accordance with another embodiment of the present disclosure. The display apparatus 200 comprises an image renderer 202 having an array 204 of pixels, a liquid-crystal device 206, and at least one processor (depicted as a processor 208). The liquid-crystal device 206 comprises a liquid-crystal structure 210, and a control circuit 212. The liquid-crystal structure 210 is arranged in front of the array 204 of pixels, wherein a plurality of portions of the liquid-crystal structure 210 are arranged in front of corresponding pixels of said array 204. The control circuit 212 comprises a plurality of circuit elements (depicted as circuit elements 214, 215, 216, 217, 218, and 219) that are to be employed to electrically control corresponding portions of the liquid-crystal structure 210. The plurality of circuit elements 214-219 comprises a first group 220 of circuit elements 214-216, and a second group 222 of circuit elements 217-219 that are associated with a first layer and a second layer, respectively, of a liquid-crystal substance of the liquid-crystal structure 210. The control circuit 212 further comprises an off-the-shelf display controller 224.

It may be understood by a person skilled in the art that the FIGS. 1 and 2 include simplified architectures of display apparatuses 100 and 200 for sake of clarity, which should not unduly limit the scope of the claims herein. The person skilled in the art will recognize many variations, alternatives, and modifications of embodiments of the present disclosure. For example, the display apparatus 100 may further comprise a collimator (not shown) arranged between the image renderer 102 and the liquid-crystal structure 110.

Figure 3:
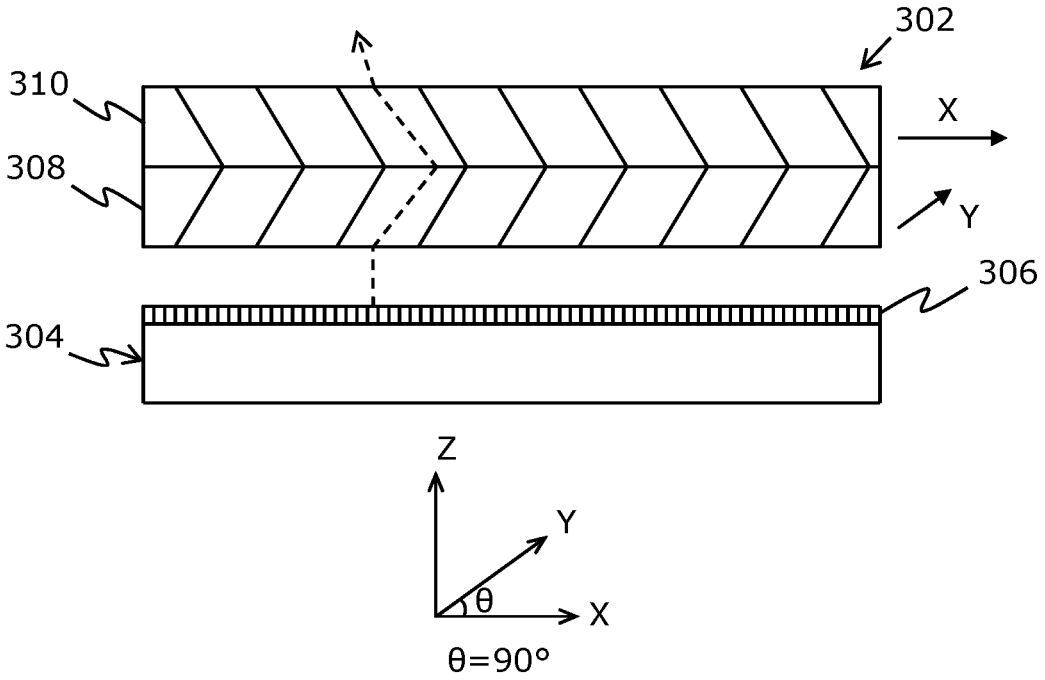
FIG. 3 illustrates an arrangement of an exemplary liquid-crystal structure and an exemplary image renderer, in accordance with an embodiment of the present disclosure.

Referring to FIG. 3, illustrated is an arrangement of an exemplary liquid-crystal structure 302 and an exemplary image renderer 304, in accordance with an embodiment of the present disclosure. As shown, the liquid-crystal structure 302 is arranged in front of an array 306 of pixels of the given image renderer 304. The liquid-crystal structure 302 comprises a first layer 308 and a second layer 310 of a liquid-crystal substance, wherein a given portion of the liquid-crystal structure 302 comprises a given portion of the first layer 308 and a given portion of the second layer 310. The given portion of the first layer 308, when addressed, directs light received thereat from a corresponding pixel (of the array 306) towards a first direction (depicted, for example, as a direction along an exemplary Y-axis). The given portion of the second layer 310, when addressed, directs light received thereat from the given portion of the first layer 308 in a second direction (depicted, for example, as a direction along an exemplary X-axis), the second direction being orthogonal to the first direction. For sake of simplicity, an exemplary optical path of only a single ray (depicted as a dashed arrow) of light emanating from the corresponding pixel is depicted.

Figure 4A:
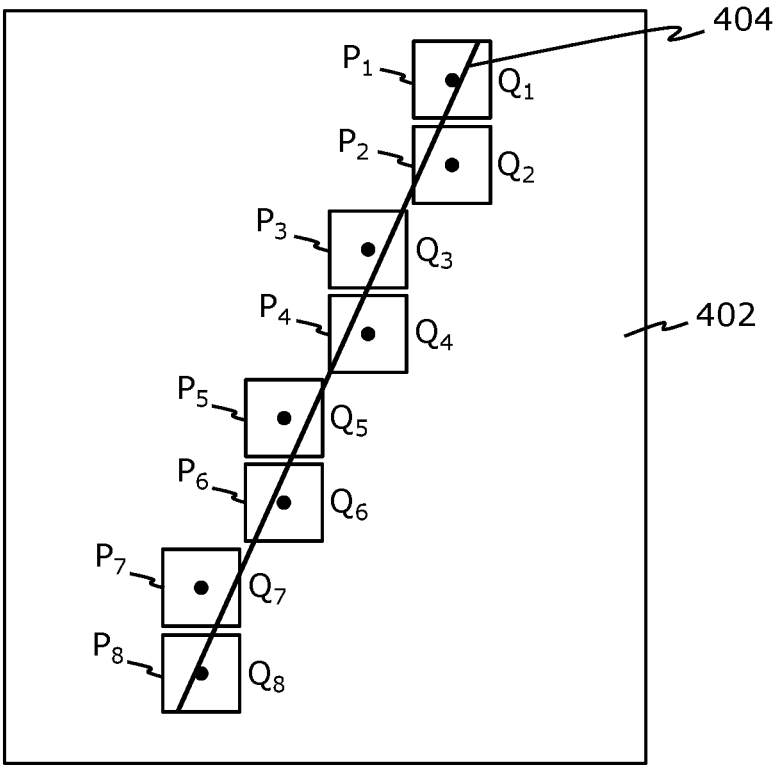
Figure 4B:
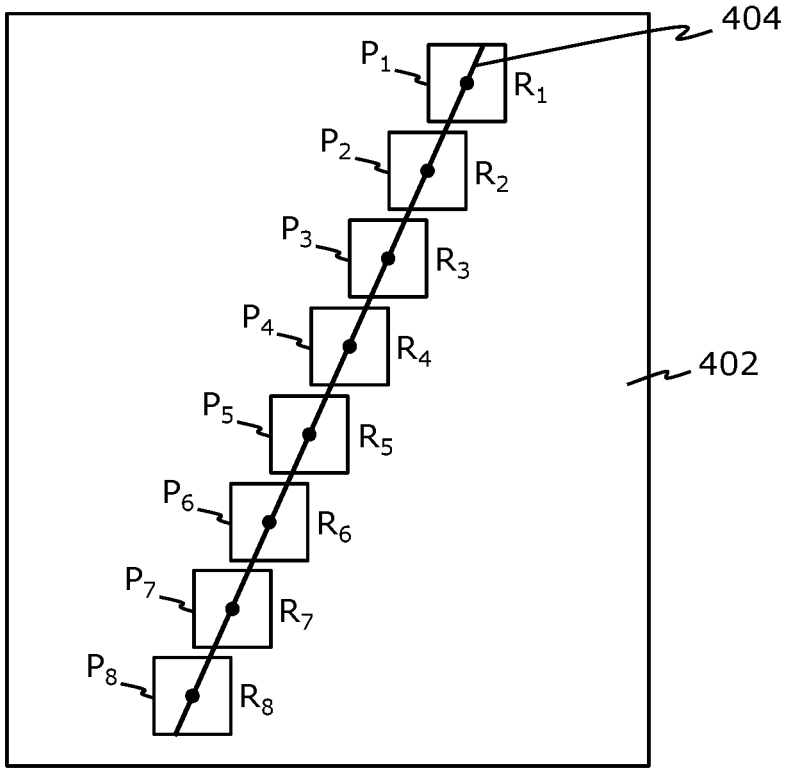
FIG. 4B illustrates an exemplary schematic illustration of the image plane after per-pixel shifting, in accordance with an embodiment of the present disclosure.

Referring to FIGS. 4A and 4B, FIG. 4A illustrates an exemplary schematic illustration of an image plane 402 before per-pixel shifting, while FIG. 4B illustrates an exemplary schematic illustration of the image plane 402 after per-pixel shifting, in accordance with an embodiment of the present disclosure. Herein, light emanating from pixels that display a feature 404 from an output image frame is incident upon the image plane 402. The feature 404 represents an inclined line. The feature 404 is displayed by a group of 8 pixels P1, P2, P3, P4, P5, P6, P7, and P8 lying along the feature 404.

In FIG. 4A, light emanating from the 8 pixels P1, P2, P3, P4, P5, P6, P7, and P8, is incident upon 8 initial target positions Q1, Q2, Q3, Q4, Q5, Q6, Q7, and Q8, respectively, on the image plane 402 in a manner that the feature 404 would appear jagged (and not smooth) on the image plane 402. In such a case, the 8 initial target positions Q1-Q8 corresponding to the 8 pixels P1-P8 are required to be adjusted so that the feature 404 appears optimally smooth (and not jagged, such as in FIG. 4A) as shown in FIG. 4B. Therefore, at least one processor (not shown) is configured to generate 8 drive signals for 8 circuit elements (not shown) that are employed to address 8 portions of a liquid-crystal structure (not shown) that lie in front of the 8 pixels P1-P8, respectively, in a manner that the light emanating from the 8 pixels P1, P2, P3, P4, P5, P6, P7, and P8 is shifted, for example, rightwards by Y1 units (i.e. towards a target position R1 in FIG. 4B), leftwards by Y2 units (towards a target position R2 in FIG. 4B), rightwards by Y3 units (towards a target position R3 in FIG. 4B), leftwards by Y4 units (towards a target position R4 in FIG. 4B), rightwards by Y5 units (i.e. towards a target position R5 in FIG. 4B), leftwards by Y6 units (towards a target position R6 in FIG. 4B), rightwards by Y7 units (towards a target position R7 in FIG. 4B), and leftwards by Y8 units (towards a target position R8 in FIG. 4B), from the 8 initial target positions Q1, Q2, Q3, Q4, Q5, Q6, Q7, and Q8, respectively.

In FIG. 4B, the light emanating from the 8 pixels P1, P2, P3, P4, P5, P6, P7, and P8, has been shifted to 8 target positions R1, R2, R3, R4, R5, R6, R7, and R8, respectively on the image plane 402 in a manner that the feature 404 appears smooth (and not jagged) on the image plane 402. In FIGS. 4A and 4B, centers of the 8 initial target positions Q1-Q8, and the 8 target positions R1-R8, respectively, are depicted as dots. As shown in FIG. 4A, the centers of the 8 initial target positions Q1-Q8 lie along the feature 404 in a jagged manner, whereas in FIG. 4B, the centers of the 8 target positions R1-R8 lie along the feature 404 in a smooth manner.

Figure 5:
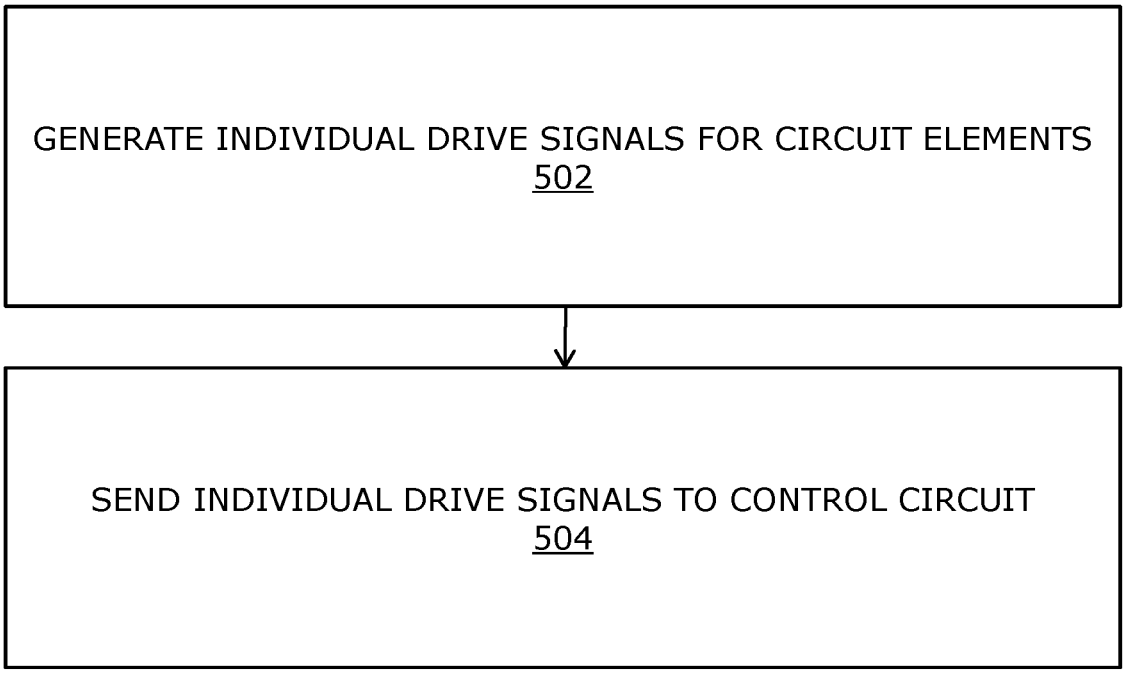
FIG. 5 illustrates steps of a method of displaying via a display apparatus, in accordance with an embodiment of the present disclosure.

Referring to FIG. 5, illustrated are steps of a method of displaying via a display apparatus, in accordance with an embodiment of the present disclosure. The display apparatus comprises an image renderer and a liquid-crystal device, the liquid-crystal device comprising a liquid-crystal structure, arranged in front of an array of pixels of the image renderer, and a control circuit comprising a plurality of circuit elements that are employed to electrically control corresponding portions of the liquid-crystal structure to shift light emanating from corresponding pixels to corresponding target positions on an image plane. At step 502, individual drive signals are generated for the plurality of circuit elements, based on the corresponding target positions on the image plane to which the light emanating from the corresponding pixels are to be shifted upon passing through the corresponding portions of the liquid-crystal structure. At step 504, the individual drive signals are sent to the control circuit to drive the plurality of circuit elements to address the corresponding portions of the liquid-crystal structure separately, whilst displaying a given output image frame via the image renderer.

The steps 502 and 504 are only illustrative and other alternatives can also be provided where one or more steps are added, one or more steps are removed, or one or more steps are provided in a different sequence without departing from the scope of the claims herein.

Modifications to embodiments of the present disclosure described in the foregoing are possible without departing from the scope of the present disclosure as defined by the accompanying claims. Expressions such as "including", "comprising", "incorporating", "have", "is" used to describe and claim the present disclosure are intended to be construed in a non-exclusive manner, namely allowing for items, components or elements not explicitly described also to be present. Reference to the singular is also to be construed to relate to the plural.

What is claimed is:

1. A display apparatus comprising:

an image renderer having an array of pixels;

a liquid-crystal device comprising:

a liquid-crystal structure arranged in front of the array of pixels, wherein a plurality of portions of the liquid-crystal structure are arranged in front of corresponding pixels of said array; and a control circuit comprising a plurality of circuit elements that are to be employed to electrically control corresponding portions of the liquid-crystal structure to shift light emanating from the corresponding pixels to corresponding target positions on an image plane; and at least one processor configured to:

generate individual drive signals for the plurality of circuit elements, based on the corresponding target positions on the image plane to which the light emanating from the corresponding pixels are to be shifted upon passing through the corresponding portions of the liquid-crystal structure; and send the individual drive signals to the control circuit to drive the plurality of circuit elements to address the corresponding portions of the liquid-crystal structure separately, whilst displaying a given output image frame via the image renderer;

wherein, when generating the individual drive signals, the at least one processor is configured to:

extract a plurality of features from the given output image frame;

determine a given group of pixels that are to display a given feature of the given output image frame;

determine a given target position on the image plane which light emanating from a given pixel of the given group is to be shifted during display of the given output image frame; and generate a drive signal for a given circuit element to be employed to address a given portion of the liquid-crystal structure that lies in front of the given pixel, based on a direction pointing from an initial target position of the light emanating from the given pixel towards the given target position.

2. The display apparatus of claim 1, wherein, when generating the individual drive signals, the at least one processor is configured to select the given feature from amongst the plurality of features based on a type of the given feature.

3. The display apparatus of claim 1, wherein the given feature is any of: an inclined edge, an inclined line.

4. The display apparatus of claim 1, wherein, when generating the individual drive signals, the at least one processor is configured to determine the given target position to which the light emanating from the given pixel is to be shifted, based on at least one target position on the image plane to which light emanating from at least one neighbouring pixel of the given group is to be shifted during the display of the given output image frame.

5. The display apparatus of claim 4, wherein, when generating the individual drive signals, the at least one processor is configured to determine the given target position and the at least one target position for the given pixel and the at least one neighbouring pixel, respectively, in an iterative manner.

6. The display apparatus of claim 1, wherein the liquid-crystal structure comprises at least a first layer and a second layer of a liquid-crystal substance, a given portion of the liquid-crystal structure comprising a given portion of the first layer and a given portion of the second layer, wherein, when addressed, the given portion of the first layer directs light received thereat from a corresponding pixel towards a first direction, and wherein, when addressed, the given portion of the second layer directs light received thereat from the given portion of the first layer in a second direction, the second direction being orthogonal to the first direction.

7. The display apparatus of claim 6, wherein the plurality of circuit elements comprise a first group of circuit elements associated with the first layer and a second group of circuit elements associated with the second layer, wherein a first channel and a second channel are employed to drive the circuit elements of the first group and the circuit elements of the second group, respectively.

8. The display apparatus of claim 1, wherein the control circuit further comprises an off-the-shelf display controller that is to be employed to address the plurality of portions of the liquid-crystal structure separately.

9. A method of displaying, via a display apparatus comprising an image renderer and a liquid-crystal device, the liquid-crystal device comprising a liquid-crystal structure, arranged in front of an array of pixels of the image renderer, and a control circuit comprising a plurality of circuit elements that are employed to electrically control corresponding portions of the liquid-crystal structure to shift light emanating from corresponding pixels to corresponding target positions on an image plane, the method comprising:

generating individual drive signals for the plurality of circuit elements, based on the corresponding target positions on the image plane to which the light emanating from the corresponding pixels are to be shifted upon passing through the corresponding portions of the liquid-crystal structure; and sending the individual drive signals to the control circuit to drive the plurality of circuit elements to address the corresponding portions of the liquid-crystal structure separately, whilst displaying a given output image frame via the image renderer;

wherein the step of generating the individual drive signals comprises:

extracting a plurality of features from the given output image frame;

determining a given group of pixels that are to display a given feature of the given output image frame;

determining a given target position on the image plane to which light emanating from a given pixel of the given group is to be shifted during display of the given output image frame; and generating a drive signal for a given circuit element to be employed to address a given portion of the liquid-crystal structure that lies in front of the given pixel, based on a direction pointing from an initial target position of the light emanating from the given pixel towards the given target position.

10. The method of claim 9, wherein the step of generating the individual drive signals further comprises selecting the given feature from amongst the plurality of features based on a type of the given feature.

11. The method of claim 9, wherein the given feature is any of: an inclined edge, an inclined line.

12. The method of claim 9, wherein the step of generating the individual drive signals further comprises determining the given target position to which the light emanating from the given pixel is to be shifted, based on at least one target position on the image plane to which light emanating from at least one neighbouring pixel of the given group is to be shifted during the display of the given output image frame.

13. The method of claim 12, wherein the given target position and the at least one target position are determined for the given pixel and the at least one neighbouring pixel, respectively, in an iterative manner.

14. The method of claim 9, wherein the liquid-crystal structure comprises at least a first layer and a second layer of a liquid-crystal substance, a given portion of the liquid-crystal structure comprising a given portion of the first layer and a given portion of the second layer, wherein the method further comprises:

addressing the given portion of the first layer to direct light received thereat from a corresponding pixel towards a first direction; and addressing the given portion of the second layer to direct light received thereat from the given portion of the first layer in a second direction, the second direction being orthogonal to the first direction.

15. The method of claim 14, wherein the plurality of circuit elements comprise a first group of circuit elements associated with the first layer and a second group of circuit elements associated with the second layer, wherein a first channel and a second channel are employed to drive the circuit elements of the first group and the circuit elements of the second group, respectively.

16. The method of claim 9, wherein the control circuit further comprises an off-the-shelf display controller that is employed to address the plurality of portions of the liquid-crystal structure separately.

* * * * *